US008671912B2

(12) United States Patent
Eisenmenger et al.

(10) Patent No.: US 8,671,912 B2
(45) Date of Patent: Mar. 18, 2014

(54) FUEL INJECTOR THE CONTROL VALVE ELEMENT OF WHICH HAS A SUPPORT REGION

(75) Inventors: Nadja Eisenmenger, Stuttgart (DE); Hans-Christoph Magel, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 580 days.

(21) Appl. No.: 12/864,114

(22) PCT Filed: Dec. 30, 2008

(86) PCT No.: PCT/EP2008/068341

§ 371 (c)(1),
(2), (4) Date: Jul. 22, 2010

(87) PCT Pub. No.: WO2009/092507

PCT Pub. Date: Jul. 30, 2009

(65) Prior Publication Data

US 2010/0294241 A1 Nov. 25, 2010

(30) Foreign Application Priority Data

Jan. 22, 2008 (DE) ..... 10 2008 005 532

(51) Int. Cl.
*F02M 69/46* (2006.01)

(52) U.S. Cl.
USPC ..... 123/456; 239/585.3; 251/129.16; 251/129.18

(58) Field of Classification Search
USPC ..... 123/467, 456; 239/584, 585.5
See application file for complete search history.

(56) References Cited

U.S. PATENT DOCUMENTS

| | | | | |
|---|---|---|---|---|
| 5,244,150 | A * | 9/1993 | Ricco et al. | 239/96 |
| 6,725,841 | B1 * | 4/2004 | Boecking | 123/467 |
| 7,255,289 | B2 * | 8/2007 | Ricco et al. | 239/88 |
| 7,458,529 | B2 * | 12/2008 | Ricco et al. | 239/585.3 |
| 7,954,787 | B2 * | 6/2011 | Ricco et al. | 251/129.16 |

(Continued)

FOREIGN PATENT DOCUMENTS

| | | | |
|---|---|---|---|
| DE | 3802648 | A1 | 8/1989 |
| DE | 19839572 | A1 | 5/1999 |

(Continued)

*Primary Examiner* — Stephen K Cronin
*Assistant Examiner* — Gonzalo Laguarda
(74) *Attorney, Agent, or Firm* — Michael Best & Friedrich LLP

(57) ABSTRACT

The invention relates to an injector, in particular, a common-rail injector for injection of fuel into a combustion chamber of an internal combustion engine. An injection valve element, adjustable between a closed position and an open position, is controllable by means of a control valve. The control valve has a control valve element, adjustable between a closed position and an open position by means of an actuator, which in the closed position is an at least almost pressure-equalized and has a sealing line which cooperates in a sealing manner with a control valve seat. The sealing line of the control valve element is lifted off the control valve seat in the open position and hence opens fuel flow from a high pressure region to a low pressure region of the injector. According to the invention, the control valve element has a support region extending over the sealing line in a radial direction to the high pressure region.

16 Claims, 3 Drawing Sheets

(56) References Cited

U.S. PATENT DOCUMENTS

| | | | | |
|---|---|---|---|---|
| 2006/0000453 | A1 | 1/2006 | Ricco et al. | |
| 2006/0027684 | A1 | 2/2006 | Ricco et al. | |
| 2007/0199544 | A1* | 8/2007 | Sun et al. | 123/467 |
| 2007/0205302 | A1 | 9/2007 | Ricco et al. | |
| 2009/0205614 | A1* | 8/2009 | Hlousek et al. | 123/476 |
| 2010/0181392 | A1* | 7/2010 | Melzer et al. | 239/533.3 |

FOREIGN PATENT DOCUMENTS

| | | | |
|---|---|---|---|
| DE | 102006036446 | A1 | 2/2008 |
| EP | 1600627 | A1 | 11/2005 |
| EP | 1612403 | A1 | 1/2006 |
| RU | 2042859 | C1 | 8/1995 |
| RU | 2141574 | C1 | 11/1999 |
| SU | 909263 | A1 | 2/1982 |

* cited by examiner

FUEL INJECTOR THE CONTROL VALVE ELEMENT OF WHICH HAS A SUPPORT REGION

CROSS-REFERENCE TO RELATED APPLICATION

This application is a 35 USC 371 application of PCT/EP2008/068341 filed on Dec. 30, 2008.

BACKGROUND OF THE INVENTION

1. Field of the Invention

The invention relates to an injector, in particular a common rail injector, for injecting fuel into a combustion chamber of an internal combustion engine.

2. Description of the Prior Art

From European Patent Disclosure EP 1 612 403 A1, an injector embodied as a common rail injector is known, having an axially pressure-balanced control valve (servo valve) for blocking and opening a fuel outflow conduit from a control chamber. By means of the control valve, the fuel pressure inside the control chamber can be varied, and the control chamber is constantly supplied with fuel at high pressure, via an inflow throttle restriction. By varying the fuel pressure inside the control chamber, an injection valve element is adjusted between an open position and a closed position, and in its open position the injection valve element enables the fuel flow into the combustion chamber of an internal combustion engine. The control valve includes a sleevelike control valve element, which is adjustable in the axial direction by means of an electromagnetic actuator and which is guided on a guide bolt embodied in one piece with a valve piece. The sleevelike control valve element, with its inside circumference, defines a valve chamber, embodied at a reduced-diameter portion of the guide bolt, of the control valve radially outward only, so that no opening or closing forces from the fuel at high pressure act on the control valve inside the valve chamber. On the face end of the control valve element, there is a sealing line, which cooperates in sealing fashion with a control valve seat disposed on the valve piece. The diameter of the sealing line is equivalent to the guide diameter of the control valve element, and the guide diameter is equivalent to the outside diameter of the guide component, plus a minimal play. Because of its pressure equilibrium, the control valve is suitable for switching very high pressures. A disadvantage of the known injector is the heavy burden on the linear sealing edge upon closure of the control valve, which can lead to not inconsiderable wear at the sealing line.

OBJECT AND ADVANTAGES OF THE INVENTION

It is the object of the invention to propose an injector with a control valve that is at least approximately pressure-balanced in the axial direction, and in which the wear at the sealing line of the control valve element is reduced.

The invention is based on the concept of increasing the stability, that is, the invulnerability to wear, of the control valve element by providing that a support region, which extends in the radial direction past the sealing line into the high-pressure region of the injector, which region, when the control valve is open, communicates with the low-pressure region of the injector in order to bring about a rapid pressure drop in the control chamber of the injector, which in turn results in an opening motion of the injection valve element, is associated with the approximately linear control valve element sealing edge (sealing line) that in the closed position of the control valve rests in sealing fashion on a control valve seat. In other words, in an injector embodied in accordance with the concept of the invention, the control valve element is bounded, in the radial direction toward the pressure chamber, not by the sealing edge but by a support region adjoining the sealing line. Because the invention provides a support region, the impact impetus with which the control valve element strikes the control valve seat associated with it is distributed more uniformly in the control valve, and in particular in the control valve element, and as a consequence leads to lesser component stresses. This in turn results in increased stability of the control valve element, with the positive consequence that wear phenomena of the sealing line over the service life of the injector are minimized.

In a refinement of the invention, it is advantageously provided that the support region is embodied and/or disposed such that it does not, or at least not substantially, adversely affect the pressure equilibrium of the control valve element in its closed position. This can be accomplished for instance by providing that the support region is embodied and/or disposed such that the pressure forces acting on it in opposite directions at least approximately completely and preferably completely cancel another out. This is attained with a support region in which the operative or projection areas for generating pressure forces pointing in opposite directions are of equal size. This can be attained for instance by providing that the inner or outer diameter (depending on the structural form) of the control valve element in the region of the sealing line is equivalent to the diameter of the control valve element above the support region.

An embodiment of the injector that is especially advantageous is one in which the diameter of the sealing line, which widens somewhat as a result of unavoidable wear phenomena over the service life of the injector, is equivalent to the guide diameter (inside diameter or outside diameter of the control valve element—depending on the structural form of the control valve element). A completely pressure-balanced control valve is obtained if the inner diameter of the sealing line is exactly equivalent to the inner guide diameter, and/or the outer diameter of the sealing line is exactly equivalent to the outer guide diameter of the control valve element.

To minimize the effects on the pressure-balanced property of the control valve of unavoidable sealing line wear, an embodiment of the injector in which the high-pressure angle left open is greater than the low-pressure angle left open of the control valve is advantageous. The high-pressure angle left open is the angle, located in the high-pressure region, between the boundary line, adjoining the sealing line, of the support region or of the control valve element, and the control valve seat face. The low-pressure angle left open is the angle, located in the low-pressure region of the injector, between the (lower) boundary line of the control valve element and the control valve seat face.

An especially advantageous embodiment is one in which the low-pressure angle left open is selected from an angular range between approximately 0° and approximately 10°. Preferably, the low-pressure angle left open is approximately 0.5° to 5°, and especially preferably approximately 0.5° to approximately 2°. Ideally, the high-pressure angle left open is selected from an angular range between approximately 5° and approximately 60°, preferably from an angular range between approximately 10° and approximately 50°, and especially preferably from an angular range between approximately 20° and approximately 40°. An embodiment in which the difference between the high-pressure angle left open and the low-pressure angle left open is selected from an angular range up to approximately 10° is especially advantageous. Ideally, the difference in angles is between approximately 1° and approximately 5°, and especially preferably between approximately 1.5° and approximately 3°.

To make it possible to ensure manufacturing precision of the sealing line in an injector, embodied in accordance with the concept of the invention, at feasible expense, an embodiment is preferred in which the control valve element angle, which is defined by the two radially extending boundary lines, adjoining the sealing line, of the control valve element, and the control valve seat angle are not the same. Especially preferably, the difference in angles amounts to more 10°, and especially preferably more than 20°. Especially good results in terms of the manufacturing precision of the sealing line can be expected at a difference between angles in a range between approximately 30° and approximately 60°. Ideally, the control valve seat angle is greater than the control valve element angle. By the provision of a difference in angles as described above between the control valve element angle and the control valve seat angle, on the one hand there is a sufficiently great support action of the support region, and on the other, exact production of the sealing line (sealing edge) becomes possible. To increase the support action (at the expense of exact production capability), a smaller difference between angles can also be selected.

With a view to easy manufacture of the support region, an at least approximately trapezoidal embodiment of the support region is preferred, in which the oblique sides of the trapezoid are joined to one another by a line extending parallel to the longitudinal center axis of the control valve element.

A pressure-balanced control valve can be attained both with a sleevelike control valve element (valve sleeve) and with a pistonlike (not continuously hollow) control valve element. If a control valve element embodied as a valve sleeve is provided, then an embodiment in which a pressure pin is received inside the control valve element is preferred. The pressure pin is preferably embodied as a component which is separate from the valve piece having the control valve seat and which axially seals off a valve chamber embodied radially inside the control valve element. Preferably, the sleevelike control valve element is guided with its inside circumference on the outside circumference of the pressure pin, which is preferably braced on an injector component in the axial direction, preferably on an injector cap or an electromagnet assembly. In addition or alternatively to the embodiment of the pressure pin as an internal guide, an external guide for the sleevelike control valve element may be provided. Regardless of whether an internal and/or external guide for the valve sleeve is provided, the diameter of the sealing line is preferably at least approximately equivalent to the outside diameter of the pressure pin, optionally with the addition of minimal play. In an embodiment of the control valve element as a valve sleeve, the support region preferably protrudes into the valve chamber, embodied inside the sleevelike control valve element and preferably communicating directly with the control chamber, and is located in axial terms between the sealing line and the pressure pin.

In an injector with a control valve element embodied as a piston, the support region, in contrast to the embodiment described above, is preferably located on the outer circumference, and specifically, in terms of the axial direction, between the sealing line of the control valve element and a guide component, and the (outer) diameter of the sealing line is preferably equivalent to the guide diameter of the pistonlike control valve element.

It is especially advantageous to embody the control valve seat as a flat seat or conical seat.

BRIEF DESCRIPTION OF THE DRAWINGS

Further advantages, characteristics and details of the invention will become apparent from the ensuing description of preferred exemplary embodiments and from the drawings. In the drawings.

DESCRIPTION OF THE PREFERRED EMBODIMENTS

Figure 1:
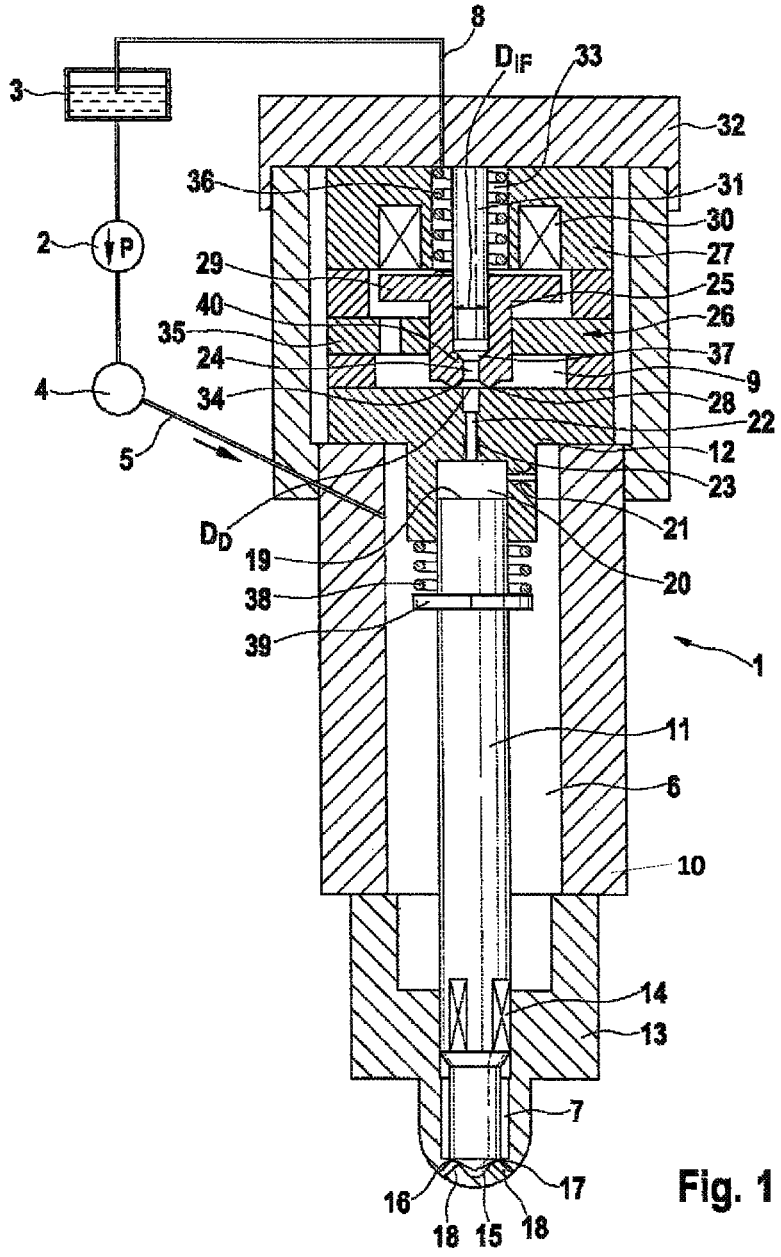
FIG. 1 schematically shows an injector, embodied as a common rail injector, with a sleevelike control valve element that has a radially inward-pointing support region for the sealing line.

In the drawings, identical components and components with the same function are identified by the same reference numerals.

In FIG. 1, an injector 1 embodied as a common rail injector for injecting fuel into a combustion chamber, not shown, of an internal combustion engine of a motor vehicle is shown. A high-pressure pump 2 pumps fuel from a tank 3 into a high-pressure fuel reservoir 4 (rail). In it, fuel, in particular diesel or gasoline, is stored at high pressure, which in this exemplary embodiment is approximately 2000 bar. The injector 1 is connected along with other injectors, not shown, to the high-pressure fuel reservoir 4 via a supply line 5. The supply line 5 discharges into a pressure chamber 6. By means of a return line 8, a low-pressure region 9 of the injector 1 is connected to the tank 3. Via the return line 8, a separate control quantity of fuel, to be explained hereinafter, can flow out from the injector 1 to the tank 3.

An injection valve element 11 is disposed inside a nozzle body 13. The injection valve element 11 is guided both longitudinally displaceably in a lower, sleevelike portion of a valve piece 12 and with axial spacing from the valve piece in a bore of a nozzle body 13. On the outer circumference of the injection valve element 11, in the vicinity of its guidance inside the nozzle body 13, axial conduits 14 (ground recesses), by way of which the pressure chamber communicates with the nozzle chamber 7. The nozzle body 13 is screwed to the injector body 10 via a union nut, not shown.

The injection valve element 11, on its tip 15, has a closing face 16, with which the injection valve element 11 can be put into tight contact with an injection valve element seat 17 embodied inside the nozzle body 13. When the injection valve element 11 is resting on its injection valve element seat 17, or in other words is in a closed position, the fuel exit from a nozzle hole arrangement 18 is blocked. Conversely, if it is lifted from its injection valve element seat 17, fuel can flow out of the pressure chamber 6 via the axial conduits 14 into the nozzle chamber 7, past the injection valve element 11, to the nozzle hole arrangement 18 inside the nozzle body 13, and there, essentially at high pressure (rail pressure), it can be injected into the combustion chamber (not shown).

A control chamber 20 is bounded by an upper face end 19 of the injection valve element 11, which instead of the one-piece embodiment shown may also be embodied in multiple parts, and by what in the plane of the drawing is the lower, sleevelike portion of the valve piece 12; and this control chamber is supplied with fuel at high pressure from the pressure chamber 6 via an inflow throttle restriction 21 extending in the sleevelike portion of the valve piece 12. Via an outflow conduit 22 with an outflow throttle restriction 23, the conduit being disposed in the upper, platelike portion of the valve piece 12, the control chamber 20 communicates with a valve chamber 24, which is bounded radially on the outside by a sleevelike control valve element 25 of a control valve 26 (servo valve). From the valve chamber 24 (high-pressure region), fuel can flow out of the valve chamber 24 into the low-pressure region 9 of the injector 1, if the control valve element 25, which is actuatable by an electromagnetic actuator 27, has lifted from its control valve seat 28 embodied as a flat seat and disposed on the platelike portion of the valve piece 12; in other words, if the control valve 26 is open. The control valve seat angle, with the flat seat shown, is 180°. The flow cross sections of the inflow throttle restriction 21 and the outflow throttle restriction 23 are adapted to one another such that with the control valve 26 open, a net outflow of fuel (control quantity) from the control chamber 20 into the low-pressure region 9 of the injector 1 via the valve chamber 24, and from there into the tank 3 via the return line 8, results.

The control valve 26 is embodied as a valve that is axially pressure-balanced in the closed state. The control valve element 25 is embodied with its upper portion, in terms of the plane of the drawing, in one piece with an armature plate 29, which cooperates with an electromagnet assembly 30 of the electromagnet actuator. Radially inside the sleevelike control valve element 25, there is a pressure pin 31, which is embodied as a separate component from the valve piece 12 and which seals off the valve chamber 24 axially upward. The pressure pin 31 withstands the pressure forces acting on it at an injector cap 32 that is screwed to the injector body 10. To that end, the pressure pin 31 passes through a central through opening 33 inside the electromagnet assembly 30. A circular-annular, linear sealing line 34 of the control valve element 25, which line, in the closed state of the control valve 26, cooperates in sealing fashion with the control valve seat 28, is located on an inner guide diameter $D_{iF}$, with which the control valve element 25 is guided on the pressure pin 31. In addition, on its outer circumference the control valve element 25 is guided by means of a guide plate 35, which is penetrated by the control valve element 25 and is located axially between the armature plate 29 and the valve piece 12 with its control valve seat 28. Inside the through opening 33, next to the pressure pin 31, which in this exemplary embodiment is embodied in one piece but can be embodied in multiple parts, is a control closing spring 36, which is braced in the axial direction on the one hand on the injector cap 32 and on the other on the unit comprising the control valve seat 25 and the armature plate 29.

If current is supplied to the electromagnet assembly 30 of the electromagnetic actuator 27, the sleevelike control valve element 25 lifts from its control valve seat 28 embodied as a flat seat, and as a result, the valve chamber 24, or in other words the high-pressure region 37 of the injector 1, communicates with the low-pressure region 9, as a result of which the pressure inside the control chamber 20, communicating hydraulically with the valve chamber 24 via the outflow throttle restriction 23, rapidly drops, and the injection valve element 11 moves axially upward, in the plane of the drawing, into the control chamber, and as a consequence, fuel can flow out of the nozzle chamber 7 into the combustion chamber.

To terminate the injection event, the current supply to the electromagnet assembly 30 of the electromagnetic actuator 27 is discontinued. The control closing spring 36 consequently moves the sleevelike control valve element 25 back onto its control valve seat 28 on the upper side, in terms of the plane of the drawing, of the valve piece 12. As a result of the replenishing fuel flowing in through the inflow throttle restriction 21, the pressure in the control chamber 20 rapidly rises, causing the injection valve element 11, reinforced by the spring force of a closing spring 38, which is braced both on a circumferential collar 39 of the injection valve element 11 and on the sleevelike, lower portion of the valve piece 12, to move in the direction of the injection valve element seat 17, as a result of which in turn the fuel flow from the nozzle hole arrangement 18 into the combustion chamber is discontinued.

As mentioned, the at least approximately linear sealing edge (sealing line 34) is located on the inner guide diameter $D_{iF}$. In other words, the (inner) diameter $D_D$ of the sealing line 34 is equivalent to the inner guide diameter $D_{iF}$ of the control valve element 25. In the radial direction, an annular trapezoidal support region 40, beginning at the sealing line 34, protrudes past the sealing line 34 and is disposed entirely inside the high-pressure region 37, or more precisely inside the valve chamber 24. Since the effective pressure engagement area of the support region for pressure forces in a first axial direction and the pressure engagement area of the support region for pressure forces in a second axial direction opposite the first axial direction are of equal size, the axial pressure equilibrium of the control valve element 25 is not adversely affected by the annular support region 40 of trapezoidal cross section. As can easily be seen from FIG. 1, viewed in the axial direction the support region 40 is located between what in the plane of the drawing is the lower, free face end of the pressure pin 31 and the control valve seat 28 embodied as a flat seat. Because of the provision of the support region 40, the sealing line does not form the radially innermost boundary of the control valve element 25.

Advantageous angular relationships in the vicinity of the sealing line 34 and in the vicinity of the control valve seat 28 will now be described in terms of the embodiment shown enlarged in FIG. 2, in which in contrast to the exemplary embodiment of FIG. 1, instead of a control valve seat 28 embodied as a flat seat, a conical control valve seat 28 embodied as an outer cone is provided. Otherwise, the exemplary embodiment of FIG. 2 is essentially equivalent to the exemplary embodiment of FIG. 1, so that to avoid repetition, the foregoing drawing description and FIG. 1 itself should be referred to for the common features.

Figure 2:
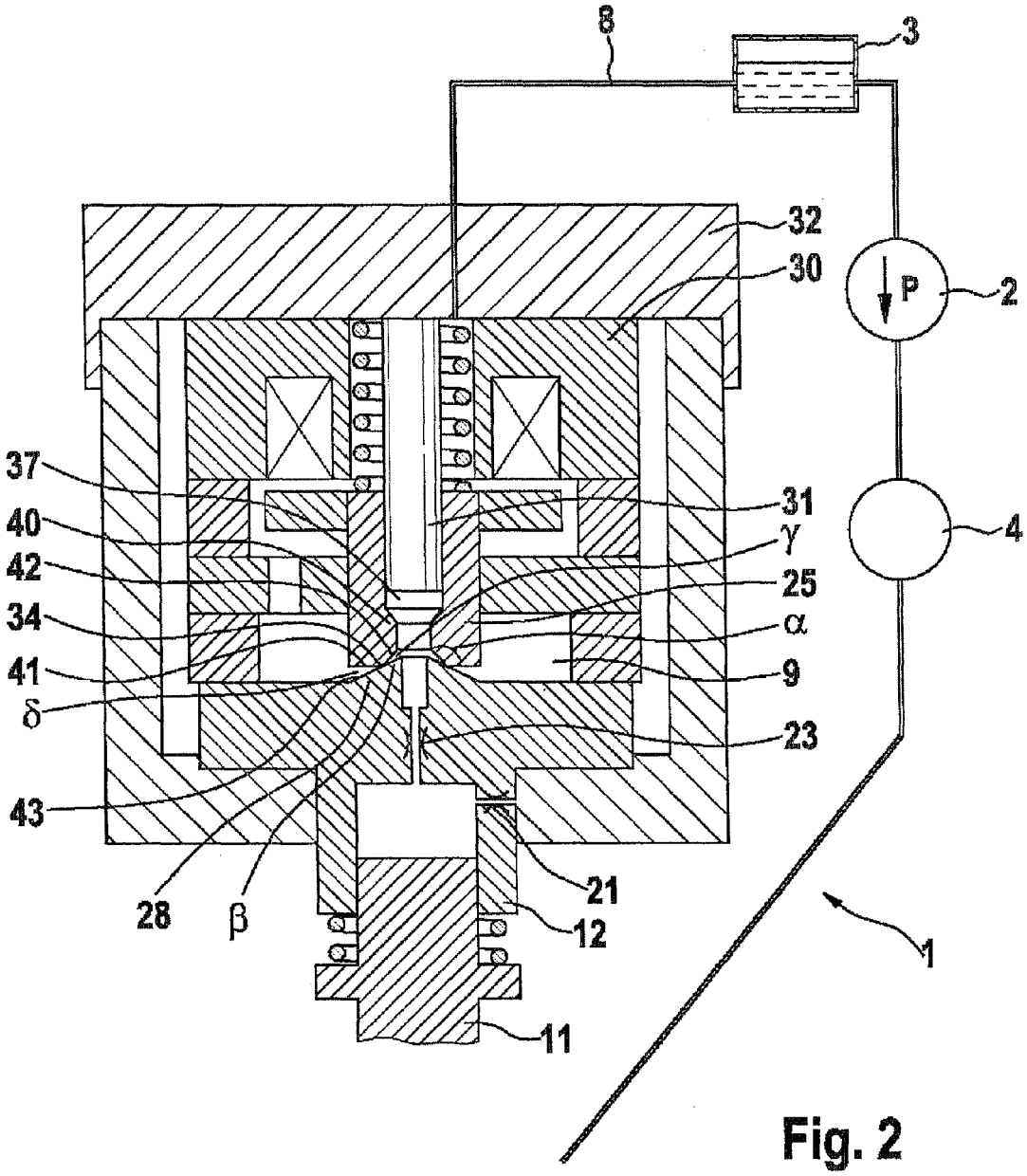
FIG. 2 is a fragmentary view of an alternative exemplary embodiment of an injector, whose sleevelike control valve element has a radially inward-pointing support region, but in contrast to the exemplary embodiment of FIG. 1, the control valve seat is embodied as a conical seat.

In FIG. 2, the sleevelike control valve element 25 is shown, into which the pressure pin 31 protrudes. Instead of the exemplary embodiment shown, in which the control valve element 25 is (additionally) guided on its outer circumference, an embodiment of the injector 1 can also be attained in which an external guide for the sleevelike control valve element is dispensed with.

It can be seen from FIG. 2 that the sleevelike control valve element 25 is bounded on what in the plane of the drawing is its lower face end by a boundary line 41, which in the exemplary embodiment shown, beginning at the sealing line 34, extends outward exactly in the radial direction. Radially inward, a lower boundary line 42 of the support region 40 adjoins the sealing line 34. The two boundary lines 41, 42 form a control valve element angle $\alpha$. In the exemplary embodiment shown, this angle amounts to approximately 140°. The control valve seat angle $\beta$, that is, the angle between two diametrically opposed face portions of the control valve seat 28, amounts to approximately 160° in the exemplary embodiment shown. The difference between the angles $\alpha$ and $\beta$ is thus 20°.

A high-pressure angle γ left open between the (lower) boundary line 42 of the support region 40 and the conical control valve seat face 43 in the high-pressure region 37 is approximately 3° larger than the low-pressure angle δ left open between the lower boundary line 41 of the control valve element 25 in the low-pressure region 9 and the control valve seat face 43. The angle relationships described in conjunction with FIG. 2 apply to the exemplary embodiment of FIG. 1 as well, except that there, the control valve seat 28 is embodied not as a conical seat but as a flat seat, and consequently, compared to the exemplary embodiment of FIG. 1, the boundary line 41 (in FIG. 2) can extend not exactly perpendicular to the longitudinal center axis of the control valve element 25.

Figure 3:
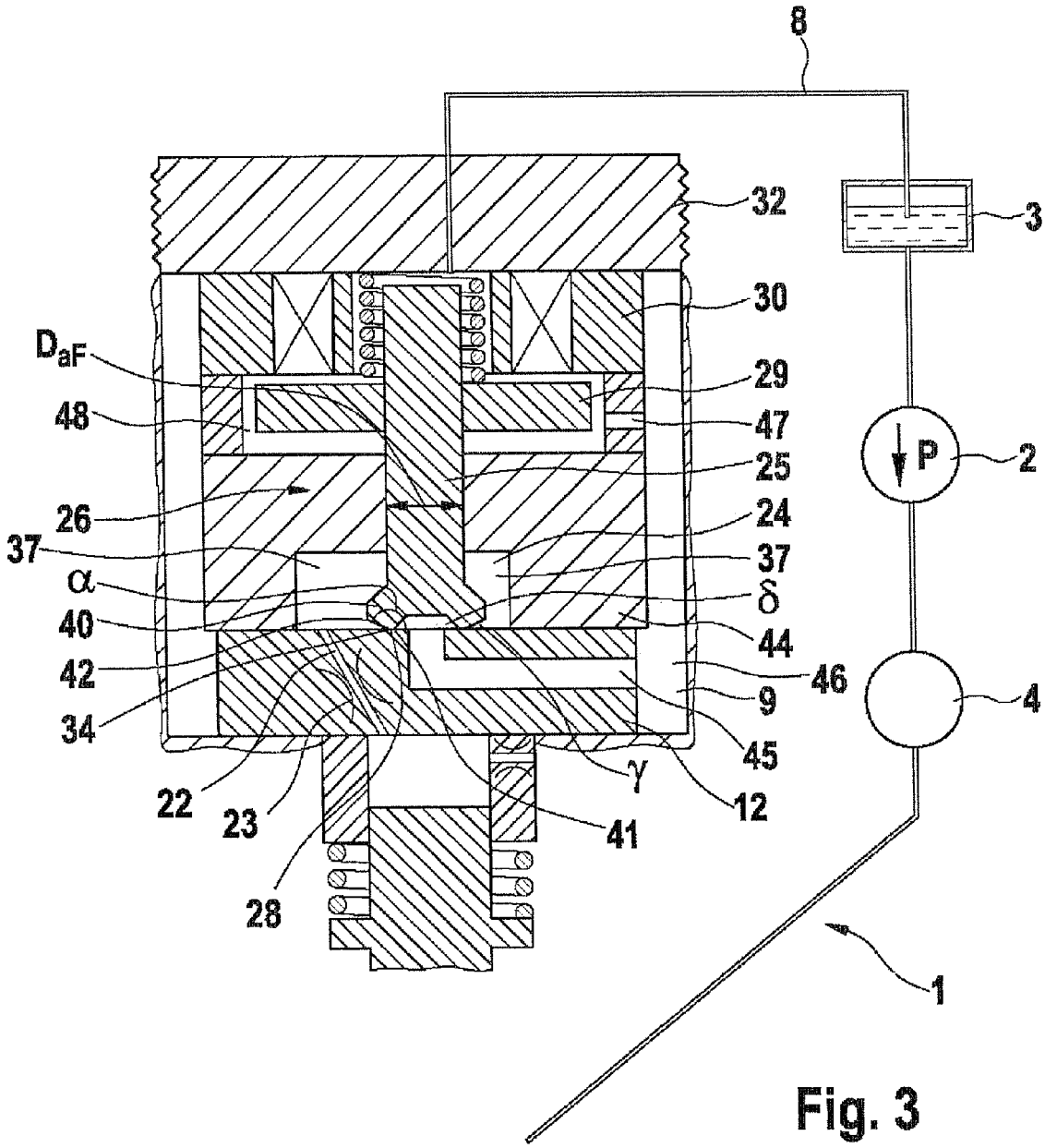
FIG. 3 is a fragmentary view of an embodiment of an injector in which the control valve element is embodied as a solid piston, which on its outer circumference, axially adjacent to the sealing line, has an encompassing support region.

In the injector 1 shown in fragmentary form in FIG. 3, the control valve element 25 is embodied as a piston of solid material, that is, as a control valve element 25 without an axial through conduit. An armature plate 29 is affixed to the control valve 26 and cooperates, analogously to the exemplary embodiments described above, with the electromagnet assembly 30, which in turn is braced on the injector cap 32.

The control valve element 25 is guided with its outer circumference in a guide component 44, which is penetrated by the control valve element 25. The control valve element 25, in its guide region, has an outer diameter $D_{aF}$, which is equivalent to the diameter of the circular-annular sealing line 34 on the face end. In contrast to the exemplary embodiments described above, in the closed state of the control valve 26, the valve chamber 24 that belongs to the high-pressure region 37 of the injector 1 is not located radially inside the control valve element 25 but instead is its radially outward boundary. Consequently, the outflow conduit 22, with its outflow throttle restriction 23, leads into the valve chamber 24 located radially outside the control valve element 25; in the exemplary embodiment shown, the outflow conduit 22 is embodied as an oblique conduit inside the platelike portion of the valve piece 12.

When the control valve 26 is open, or in other words when the control valve element 25 has lifted from the control valve seat 28 embodied as a flat seat, fuel flows out of the valve chamber 24 radially inward into a low-pressure conduit 45 inside the valve piece 12; the lower-pressure conduit 45 belongs to the low-pressure region 9 of the injector 1. The low-pressure conduit 45 discharges into a radially outer annular low-pressure chamber 46, which via a radial conduit 47 communicates hydraulically with an armature chamber 48. Via the armature chamber 48, fuel can flow to the return line 8 (injector return) and by way of it to the tank 3.

What is essential in the injector 1 shown in FIG. 3 is that the support region 40, which protrudes radially past the sealing line 34 and is disposed in the valve chamber 24 and thus in the high-pressure region 37 of the injector 1, is disposed on the outer circumference of the control valve element 25. The support region 40 protrudes past the outer diameter $D_{aF}$ in the guide region of the control valve element 25 and thus also, as mentioned, protrudes past the sealing line 34 in the radial direction. The control valve seat angle β (not labeled in FIG. 3) in the exemplary embodiment shown in FIG. 3 amounts to 180°, while conversely the control valve element angle α amounts to approximately 160°. Moreover, the high-pressure angle γ left open located radially outward is somewhat greater than the low-pressure angle δ left open located radially inward relative to the sealing line 34.

The foregoing relates to the preferred exemplary embodiments of the invention, it being understood that other variants and embodiments thereof are possible within the spirit and scope of the invention, the latter being defined by the appended claims.

The invention claimed is:

1. An injector for injecting fuel into a combustion chamber of an internal combustion engine, the injector having an injection valve element, which is adjustable in an axial direction between a closed position and an open position and which is triggerable by means of a control valve that has a control valve element, which control valve element is adjustable by means of an actuator between a closed position and an open position and which in the closed position is at least approximately pressure-balanced, the control valve element embodied as a sleeve and having a sealing line, which in the closed position of the control valve element cooperates with a control valve seat in sealing fashion, and which in the open position the sealing line is lifted from the control valve seat and thus enables fuel flow from a high-pressure region into a low-pressure region of the injector, the control valve element having a support region which protrudes past the sealing line in a radial direction toward the high-pressure region, wherein in the sleeve, a pressure pin in one or more parts that is separate from a valve piece having the control valve seat is received in the sleeve, and that the support region is disposed on an inside circumference of the sleeve axially between the pressure pin and the control valve seat.

2. The injector as defined by claim 1, wherein the control valve element is located between the injection valve element and the actuator and further wherein the support region is embodied such that with the control valve closed, no resultant pressure forces act on the support region in the axial direction.

3. The injector as defined by claim 1, wherein a diameter $D_D$ of the sealing line is at least approximately equivalent to a guide diameter $D_{iF}$, $D_{AF}$ of the control valve element.

4. The injector as defined by claim 2, wherein a diameter $D_D$ of the sealing line is at least approximately equivalent to a guide diameter $D_{iF}$, $D_{AF}$ of the control valve element.

5. The injector as defined by claim 1, wherein a high-pressure angle γ between a boundary line of the support region oriented toward the control valve seat and adjoining the sealing line in the high-pressure region, and the control valve seat face is greater than a low-pressure angle δ between a boundary line of the control valve element adjoining the sealing line in the low-pressure region and oriented toward the control valve seat, and the control valve seat face.

6. The injector as defined by claim 2, wherein a high-pressure angle γ between a boundary line of the support region oriented toward the control valve seat and adjoining the sealing line in the high-pressure region, and the control valve seat face is greater than a low-pressure angle δ between a boundary line of the control valve element adjoining the sealing line in the low-pressure region and oriented toward the control valve seat, and the control valve seat face.

7. The injector as defined by claim 3, wherein a high-pressure angle γ between a boundary line of the support region oriented toward the control valve seat and adjoining the sealing line in the high-pressure region, and the control valve seat face is greater than a low-pressure angle δ between a boundary line of the control valve element adjoining the sealing line in the low-pressure region and oriented toward the control valve seat, and the control valve seat face.

8. The injector as defined by claim 4, wherein a high-pressure γ angle between a boundary line of the support region oriented toward the control valve seat and adjoining the sealing line in the high-pressure region, and the control valve seat face is greater than a low-pressure angle δ between a boundary line of the control valve element adjoining the sealing line in the low-pressure region and oriented toward the control valve seat, and the control valve seat face.

9. The injector as defined by claim 5, wherein the low-pressure angle $\gamma$ is selected from an angular range between approximately 0° and approximately 10° and/or that the high-pressure angle $\delta$ is selected from an angular range between approximately 5° and approximately 60°.

10. The injector as defined by claim 8, wherein the low-pressure angle $\gamma$ is selected from an angular range between approximately 0° and approximately 10° and/or that the high-pressure angle $\delta$ is selected from an angular range between approximately 5° and approximately 60°.

11. The injector as defined by claim 1, wherein a difference between a control valve element angle a defined by boundary lines adjoining the sealing line, and a control valve seat angle $\beta$ is greater than 10°.

12. The injector as defined by claim 10, wherein a difference between a control valve element angle $\alpha$ defined by boundary lines adjoining the sealing line, and a control valve seat angle $\beta$ is greater than 10°.

13. The injector as defined by claim 1, wherein the support region is embodied as at least trapezoidal in cross section.

14. The injector as defined by claim 12, wherein the support region is embodied as at least trapezoidal in cross section.

15. The injector as defined by claim 1, wherein the control valve seat is embodied as a flat seat or as a conical seat.

16. The injector as defined by claim 5, wherein the control valve seat is embodied as a flat seat or as a conical seat.

* * * * *

UNITED STATES PATENT AND TRADEMARK OFFICE

CERTIFICATE OF CORRECTION

PATENT NO. : 8,671,912 B2
APPLICATION NO. : 12/864114
DATED : March 18, 2014
INVENTOR(S) : Eisenmenger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 582 days.

Signed and Sealed this
Twenty-ninth Day of September, 2015

Michelle K. Lee

Michelle K. Lee
*Director of the United States Patent and Trademark Office*